US010502426B2

(12) United States Patent
Lemon et al.

(10) Patent No.: US 10,502,426 B2
(45) Date of Patent: Dec. 10, 2019

(54) DUAL FUEL INJECTORS AND METHODS OF USE IN GAS TURBINE COMBUSTOR

(71) Applicant: General Electric Company, Schenectady, NY (US)

(72) Inventors: Donald Timothy Lemon, Greenville, SC (US); Gilbert Otto Kraemer, Greer, SC (US); Wei Chen, Greer, SC (US); Marcus Byron Huffman, Simpsonville, SC (US); Ronnie Ray Pentecost, Travelers Rest, SC (US)

(73) Assignee: General Electric Company, Schenectady, NY (US)

( * ) Notice: Subject to any disclaimer, the term of this patent is extended or adjusted under 35 U.S.C. 154(b) by 232 days.

(21) Appl. No.: 15/593,543

(22) Filed: May 12, 2017

(65) Prior Publication Data

US 2018/0328588 A1 Nov. 15, 2018

(51) Int. Cl.

| | |
|---|---|
| ***F23R 3/36*** | (2006.01) |
| ***F23R 3/28*** | (2006.01) |
| ***F23L 7/00*** | (2006.01) |
| ***F23R 3/34*** | (2006.01) |

(52) U.S. Cl.

CPC ..... *F23R 3/36* (2013.01); *F23L 7/002* (2013.01); *F23R 3/283* (2013.01); *F23R 3/286* (2013.01); *F23R 3/346* (2013.01)

(58) Field of Classification Search

None

See application file for complete search history.

(56) References Cited

U.S. PATENT DOCUMENTS

| | | | |
|---|---|---|---|
| 4,903,480 | A | 2/1990 | Lee et al. |
| 5,220,787 | A | 6/1993 | Bulman |
| 5,640,851 | A | 6/1997 | Toon et al. |
| 6,915,636 | B2 | 7/2005 | Stuttaford et al. |
| 7,878,000 | B2 | 2/2011 | Mancini et al. |
| 8,113,001 | B2 | 2/2012 | Singh et al. |
| 8,171,735 | B2 | 5/2012 | Mancini et al. |
| 8,387,391 | B2 | 3/2013 | Patel et al. |
| 8,438,856 | B2 | 5/2013 | Chile et al. |
| 8,590,311 | B2 | 11/2013 | Parsania et al. |
| 8,745,987 | B2 | 6/2014 | Stoia et al. |
| 8,863,525 | B2 | 10/2014 | Toronto et al. |
| 9,200,808 | B2 | 12/2015 | Romig et al. |

(Continued)

*Primary Examiner* — Todd E Manahan
*Assistant Examiner* — Rodolphe Andre Chabreyrie
(74) *Attorney, Agent, or Firm* — Charlotte C. Wilson

(57) ABSTRACT

A fuel injector is provided for the radial introduction of a liquid fuel/air mixture to a combustor. The fuel injector includes a body having a frame that defines an inlet portion and an outlet member that defines an outlet portion. A fuel plenum is defined within the outlet member, and a fuel injection port, which communicates with the fuel plenum, is defined through the outlet member. A fuel supply conduit, fixed to the body, communicates between a source of liquid fuel and the fuel injection port, via the fuel plenum. Alternately, the fuel injector may include a swirl-inducing device mounted to the outlet member in communication with the fuel injection port, and a fuel supply conduit fixed to the swirl-inducing device. In this embodiment, the fuel supply conduit communicates between the fuel injection port and a source of a liquid fuel and water mixture, via the swirl-inducing device.

17 Claims, 15 Drawing Sheets

(56) References Cited

U.S. PATENT DOCUMENTS

| | | | | |
|---|---|---|---|---|
| 9,222,673 | B2 | 12/2015 | Boardman et al. | |
| 9,267,436 | B2 | 2/2016 | Stoia et al. | |
| 9,291,350 | B2 | 3/2016 | Melton et al. | |
| 9,303,872 | B2 * | 4/2016 | Hadley | F23R 3/20 |
| 9,316,155 | B2 | 4/2016 | DiCintio et al. | |
| 9,316,396 | B2 | 4/2016 | DiCintio et al. | |
| 9,322,556 | B2 | 4/2016 | Melton et al. | |
| 9,360,217 | B2 | 6/2016 | DiCintio et al. | |
| 9,376,961 | B2 | 6/2016 | Stoia et al. | |
| 9,383,104 | B2 | 7/2016 | Melton et al. | |
| 9,400,114 | B2 | 7/2016 | Melton et al. | |
| 9,593,851 | B2 | 3/2017 | Shershnyov et al. | |
| 2004/0006993 | A1 * | 1/2004 | Stuttaford | F23L 7/002 60/776 |
| 2014/0260280 | A1 | 9/2014 | Willis et al. | |
| 2014/0260318 | A1 | 9/2014 | Willis et al. | |
| 2014/0338353 | A1 * | 11/2014 | Milosavljevic | F23D 11/38 60/775 |
| 2014/0360193 | A1 | 12/2014 | Stoia et al. | |
| 2015/0047360 | A1 | 2/2015 | Baruah et al. | |
| 2015/0052905 | A1 | 2/2015 | Carnell et al. | |
| 2015/0285504 | A1 * | 10/2015 | Melton | B33Y 10/00 60/737 |
| 2017/0003032 | A1 * | 1/2017 | Jorgensen | F23R 3/002 |

* cited by examiner

DUAL FUEL INJECTORS AND METHODS OF USE IN GAS TURBINE COMBUSTOR

TECHNICAL FIELD

The present disclosure relates generally to fuel injectors for gas turbine combustors and, more particularly, to dual fuel injectors for use with an axial fuel staging (AFS) system associated with such combustors.

BACKGROUND

A gas turbine generally includes a compressor section, a combustion section having a combustor and a turbine section. The compressor section progressively increases the pressure of the working fluid to supply a compressed working fluid to the combustion section. The compressed working fluid is routed through and/or around an axially extending fuel nozzle that extends within the combustor. A fuel is injected into the flow of the compressed working fluid to form a combustible mixture. The combustible mixture is burned within a combustion chamber to generate combustion gases having a high temperature, pressure and velocity. The combustion gases flow through one or more liners or ducts that define a hot gas path into the turbine section. The combustion gases expand as they flow through the turbine section to produce work. For example, expansion of the combustion gases in the turbine section may rotate a shaft connected to a generator to produce electricity. The turbine may also drive the compressor by means of a common shaft or rotor.

The temperature of the combustion gases directly influences the thermodynamic efficiency, design margins, and resulting emissions of the combustor. For example, higher combustion gas temperatures generally improve the thermodynamic efficiency of the combustor. However, higher combustion gas temperatures may increase the disassociation rate of diatomic nitrogen, thereby increasing the production of undesirable emissions such as oxides of nitrogen ($NO_x$) for a particular residence time in the combustor. Conversely, a lower combustion gas temperature associated with reduced fuel flow and/or part load operation (turndown) generally reduces the chemical reaction rates of the combustion gases, thereby increasing the production of carbon monoxide (CO) and unburned hydrocarbons (UHCs) for the same residence time in the combustor.

In order to balance overall emissions performance while optimizing thermal efficiency of the combustor, certain combustor designs include multiple fuel injectors that are arranged around the liner downstream from the primary combustion zone. The fuel injectors deliver a second fuel/air mixture radially through the liner to provide for fluid communication into the combustion gas flow field. This type of system is commonly known in the art and/or the gas turbine industry as an axial fuel staging (AFS) system.

In operation, a portion of the compressed working fluid is routed through and/or around each of the fuel injectors and into the combustion gas flow field. A liquid or gaseous fuel from the fuel injectors is injected into the flow of the compressed working fluid to provide a second combustible mixture, which spontaneously combusts in a secondary combustion zone as it mixes with the hot combustion gases. The introduction of the combustible mixture into the secondary combustion zone increases the firing temperature of the combustor and, because the fuel injectors are downstream of the primary combustion zone, the combustion gases from the primary combustion zone have a first residence time, and the combustion gases from the secondary combustion zone have a second (shorter) residence time. As a result, the overall thermodynamic efficiency of the combustor may be increased without sacrificing overall emissions performance.

One challenge with injecting a liquid fuel into the combustion gas flow field using existing AFS systems is that the momentum of the combustion gases generally inhibits adequate radial penetration of the liquid fuel into the combustion gas flow field. For this reason, local evaporation of the liquid fuel may occur along an inner surface of the liner at or near the fuel injection point, thereby resulting in a high temperature zone and high thermal stresses. Another challenge associated with liquid fuel injectors is a tendency for the fuel injectors to coke at even moderately elevated temperatures.

Therefore, an improved system for injecting a liquid fuel into the combustion gas flow field for enhanced mixing would be useful.

SUMMARY

The present disclosure is directed to a dual fuel AFS fuel injector for delivering a combustible mixture of liquid fuel and air in a radial direction from the fuel injector into a combustor, thereby producing a secondary combustion zone.

According to a first embodiment, a fuel injector for a gas turbine combustor includes a body comprising a frame and an outlet member extending downstream from the frame. The frame defines an inlet portion, and the outlet member defines an outlet portion. The body defines an air flow path from the inlet portion through the outlet portion, and the outlet member defines therein a mixing chamber. A fuel plenum is defined within the outlet member, and a fuel injection port is defined through the outlet member and in flow communication with the fuel plenum. A fuel supply conduit is fixed to the body, wherein the fuel supply conduit is in flow communication between a source of liquid fuel and the fuel injection port, via the fuel plenum.

According to another embodiment, a fuel injector for a gas turbine combustor includes a body comprising a frame and an outlet member extending downstream from the frame. The frame defines an inlet portion, and the outlet member defines an outlet portion. The body defines an air flow path from the inlet portion through the outlet portion, and the outlet member defines therein a mixing chamber. A fuel injection port is defined through the outlet member and in flow communication with the mixing chamber. A swirl-inducing device is mounted to an outer surface of the outlet member in flow communication with the fuel injection port, and a fuel supply conduit is fixed to the swirl-inducing device. The fuel supply conduit is in flow communication between the fuel injection port and a source of a mixture of liquid fuel and water, such that the mixture of liquid fuel and water is delivered via the swirl-inducing device through the fuel injection port into the mixing chamber.

BRIEF DESCRIPTION OF THE DRAWINGS

A full and enabling disclosure of the present products and methods, including the best mode thereof, directed to one of ordinary skill in the art, is set forth in the specification, which refers to the appended figures, in which.

Figure 1:
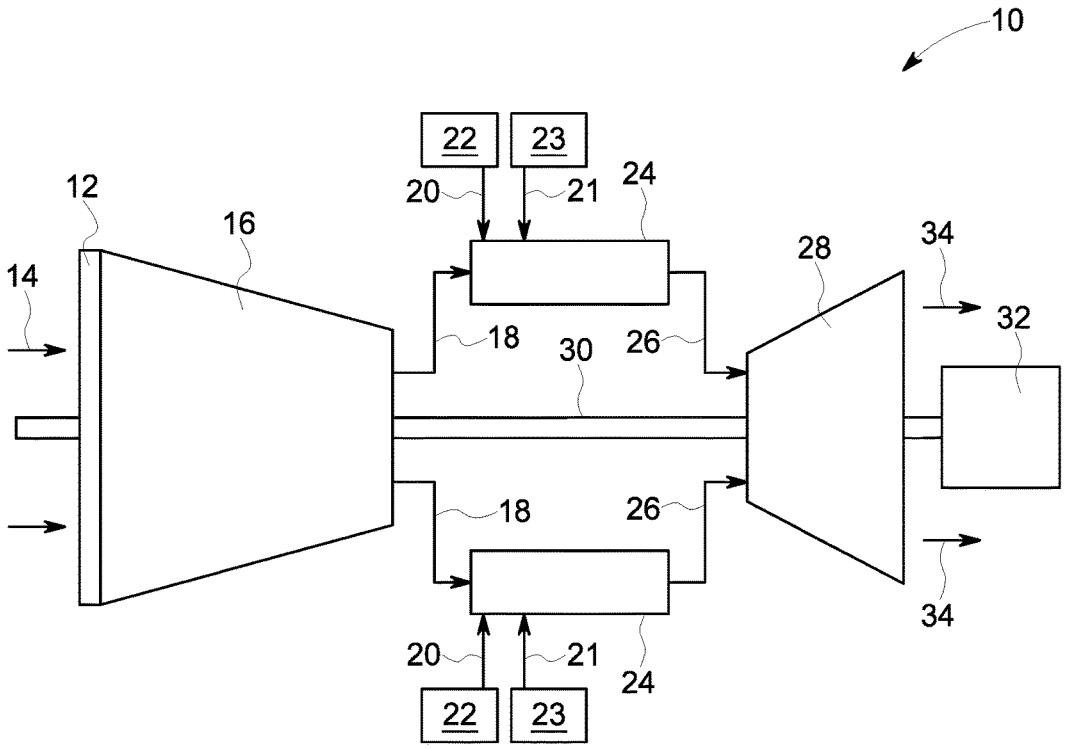
FIG. 1 is a schematic diagram of a gas turbine assembly, which may employ one or more fuel injectors, as described herein.

Unless otherwise indicated, the cross-sectional views illustrate the leading edge of the respective fuel injector (that is, the figures illustrate views taken along an axial plane from an aft position looking upstream relative to the flow of combustion products through the combustor).

DETAILED DESCRIPTION

The following detailed description illustrates various fuel injectors, their component parts, and methods of fabricating the same, by way of example and not limitation. The description enables one of ordinary skill in the art to make and use the fuel injectors. The description provides several embodiments of the fuel injectors, including what is presently believed to be the best modes of making and using the fuel injectors. An exemplary fuel injector is described herein as being coupled within a combustor of a heavy-duty gas turbine assembly used for electrical power generation. However, it is contemplated that the fuel injectors described herein have general application to a broad range of systems in a variety of fields other than electrical power generation.

As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows.

The term "radially" refers to the relative direction that is substantially perpendicular to an axial centerline of a particular component, and the term "axially" refers to the relative direction that is substantially parallel to an axial centerline of a particular component. As used herein, the term "radius" (or any variation thereof) refers to a dimension extending outwardly from a center of any suitable shape (e.g., a square, a rectangle, a triangle, etc.) and is not limited to a dimension extending outwardly from a center of a circular shape. Similarly, as used herein, the term "circumference" (or any variation thereof) refers to a dimension extending around a center of any suitable shape (e.g., a square, a rectangle, a triangle, etc.) and is not limited to a dimension extending around a center of a circular shape.

References made herein to a singular injection port should be understood as embodying one or more injection orifices, filming apertures, or simplex nozzles. Injection ports within a given fuel injector may be different in number, size, type, and/or angular orientation (e.g., normal or oblique to the surface). While a single injection port may be illustrated, it should be understood that multiple orifices may be disposed at the illustrated port. Further, where multiple injection ports are provided, the ports may be of the same size or different sizes and may be arranged in different patterns relative to the flow of air through the inlet portion of the fuel injector. For instance, the pattern may include a large orifice followed by a small orifice, a small orifice followed by a large orifice, a single orifice for a first fluid followed by multiple orifices for a second fluid, multiple orifices for a first fluid followed by a single orifice for the second fluid, and various other combinations as may be selected based upon the knowledge of those of ordinary skill in the art and/or upon routine experimentation in the practice of the present disclosure.

Each example is provided by way of explanation, not limitation of the invention. In fact, it will be apparent to those skilled in the art that modifications and variations can be made in the present fuel injectors, without departing from the scope or spirit of the present disclosure. For instance, features illustrated or described as part of one embodiment may be used on another embodiment to yield a still further embodiment. Thus, it is intended that the present disclosure encompasses such modifications and variations as fall within the scope of the appended claims and their equivalents. Although exemplary embodiments of the present fuel injectors will be described generally in the context of a combustor incorporated into a gas turbine for purposes of illustration, one of ordinary skill in the art will readily appreciate that embodiments of the present disclosure may be applied to any combustor incorporated into any turbomachine and is not limited to a gas turbine combustor, unless specifically recited in the claims.

Reference will now be made in detail to various embodiments of the present fuel injectors, one or more examples of which are illustrated in the accompanying drawings. The detailed description uses numerical and letter designations to refer to features in the drawings. Like or similar designations in the drawings and description have been used to refer to like or similar parts.

FIG. 1 provides a functional block diagram of an exemplary gas turbine 10 that may incorporate various embodiments of the present disclosure. As shown, the gas turbine 10 generally includes an inlet section 12 that may include a series of filters, cooling coils, moisture separators, and/or other devices to purify and otherwise condition a working fluid (e.g., air) 14 entering the gas turbine 10. The working fluid 14 flows to a compressor section where a compressor 16 progressively imparts kinetic energy to the working fluid 14 to produce a compressed working fluid 18.

The compressed working fluid 18 is mixed with a gaseous fuel 20 from a gaseous fuel supply system 22 and/or a liquid fuel 21 from a liquid fuel supply system 23 to form a combustible mixture within one or more combustors 24. The combustible mixture is burned to produce combustion gases 26 having a high temperature, pressure, and velocity. The combustion gases 26 flow through a turbine 28 of a turbine section to produce work. For example, the turbine 28 may be connected to a shaft 30 so that rotation of the turbine 28 drives the compressor 16 to produce the compressed working fluid 18. Alternately or in addition, the shaft 30 may connect the turbine 28 to a generator 32 for producing electricity. Exhaust gases 34 from the turbine 28 flow through an exhaust section (not shown) that connects the turbine 28 to an exhaust stack downstream from the turbine. The exhaust section may include, for example, a heat recovery steam generator (not shown) for cleaning and extracting additional heat from the exhaust gases 34 prior to release to the environment.

The combustors 24 may be any type of combustor known in the art, and the present invention is not limited to any particular combustor design unless specifically recited in the claims. For example, the combustor 24 may be a can type or a can-annular type of combustor.

Figure 2:
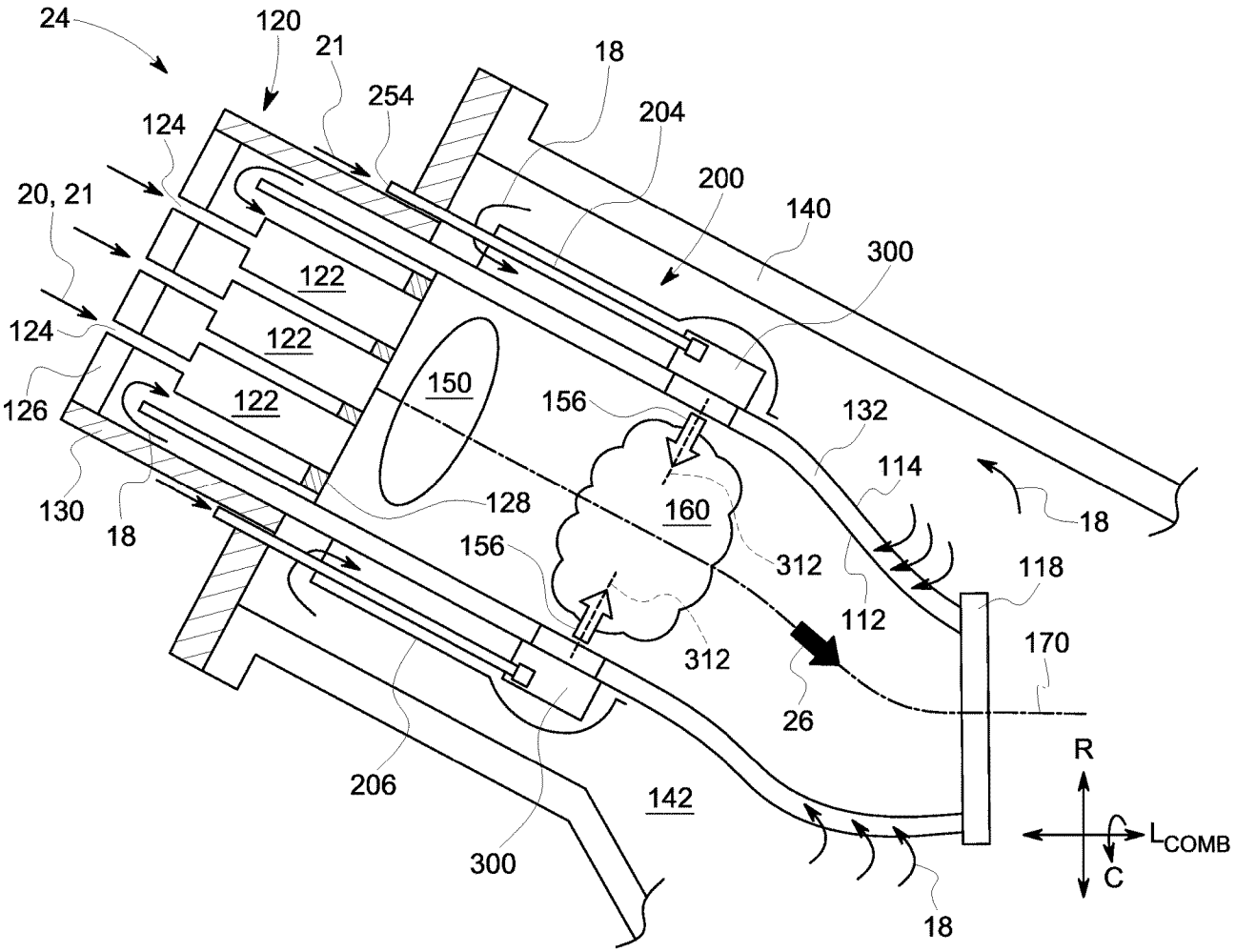
FIG. 2 is a cross-sectional view of a combustor, which may be used in the gas turbine assembly of FIG. 1.

FIG. 2 is a schematic representation of a combustion can 24, as may be included in a can annular combustion system for the heavy-duty gas turbine 10. In a can annular combustion system, a plurality of combustion cans 24 (e.g., 8, 10, 12, 14, 16, or more) are positioned in an annular array about the shaft 30 that connects the compressor 16 to the turbine 28.

As shown in FIG. 2, the combustion can 24 includes a liner 112 that contains and conveys combustion gases 26 to the turbine. The liner 112 defines a combustion chamber within which combustion occurs. The liner 112 may have a cylindrical liner portion and a tapered transition portion that is separate from the cylindrical liner portion, as in many conventional combustion systems. Alternately, the liner 112 may have a unified body (or "unibody") construction, in which the cylindrical portion and the tapered portion are integrated with one another. Thus, any discussion of the liner 112 herein is intended to encompass both conventional combustion systems having a separate liner and transition piece and those combustion systems having a unibody liner. Moreover, the present disclosure is equally applicable to those combustion systems in which the transition piece and the stage one nozzle of the turbine are integrated into a single unit, sometimes referred to as a "transition nozzle" or an "integrated exit piece."

The liner 112 is surrounded by an outer sleeve 114, which is spaced radially outward of the liner 112 to define an annulus 132 between the liner 112 and the outer sleeve 114. The outer sleeve 114 may include a flow sleeve portion at the forward end and an impingement sleeve portion at the aft end, as in many conventional combustion systems. Alternately, the outer sleeve 114 may have a unified body (or "unisleeve") construction, in which the flow sleeve portion and the impingement sleeve portion are integrated with one another in the axial direction. As before, any discussion of the outer sleeve 114 herein is intended to encompass both convention combustion systems having a separate flow sleeve and impingement sleeve and combustion systems having a unisleeve outer sleeve.

A head end portion 120 of the combustion can 24 includes one or more fuel nozzles 122. The fuel nozzles 122 have a fuel inlet 124 at an upstream (or inlet) end. The fuel inlets 124 may be formed through an end cover 126 at a forward end of the combustion can 24. The downstream (or outlet) ends of the fuel nozzles 122 extend through a combustor cap 128.

The head end portion 120 of the combustion can 24 is at least partially surrounded by a forward casing 130, which is physically coupled and fluidly connected to a compressor discharge case 140. The compressor discharge case 140 is fluidly connected to an outlet of the compressor 16 and defines a pressurized air plenum 142 that surrounds at least a portion of the combustion can 24. Air 18 flows from the compressor discharge case 140 into the annulus 132 at an aft end of the combustion can, via openings defined in the outer sleeve 114. Because the annulus 32 is fluidly coupled to the head end portion 120, the air flow 18 travels upstream from the aft end of the combustion can 24 to the head end portion 120, where the air flow 18 reverses direction and enters the fuel nozzles 122.

Fuel 20 (and/or 21) and compressed air 18 are introduced by the fuel nozzles 122 into a primary combustion zone 150 at a forward end of the liner 112, where the fuel and air are combusted to form combustion gases 26. In one embodiment, the fuel and air are mixed within the fuel nozzles 122 (e.g., in a premixed fuel nozzle). In other embodiments, the fuel and air may be separately introduced into the primary combustion zone 150 and mixed within the primary combustion zone 150 (e.g., as may occur with a diffusion nozzle). Reference made herein to a "first fuel/air mixture" should be interpreted as describing both a premixed fuel/air mixture and a diffusion-type fuel/air mixture, either of which may be produced by fuel nozzles 122. The combustion gases 26 travel downstream toward an aft end 118 of the combustion can 24, the aft end 118 being represented by an aft frame of the combustion can 24.

Additional fuel and air are introduced by one or more fuel injectors 300 into a secondary combustion zone 160, where the fuel and air are ignited by the combustion gases from the primary combustion zone 150 to form a combined combustion gas product stream 26. Such a combustion system having axially separated combustion zones is described as an "axial fuel staging" (AFS) system 200, and the downstream injectors 300 may be referred to as "AFS injectors."

In the embodiment shown, fuel (e.g., liquid fuel 21) for each AFS injector 300 is supplied from the forward end of the combustion can 24, via a respective fuel inlet 254. Each fuel inlet 254 is coupled to a fuel supply line 204, which is coupled to a respective AFS injector 300. It should be understood that other methods of delivering fuel to the AFS injectors 300 may be employed, including supplying fuel from a ring manifold or from radially oriented fuel supply lines that extend through the compressor discharge case 140. Further, while FIG. 3 illustrates both the liquid fuel supply lines 204 and the gaseous fuel supply lines 202 extending axially along an outer surface of the combustor can 24 to the fuel injectors 300, it should be understood that one or both of the gaseous fuel 20 and the liquid fuel 21 may be supplied from a ring manifold or from radially oriented fuel supply lines that extend through the compressor discharge case 140.

The fuel injectors 300 inject a second fuel/air mixture 156, in a radial direction along an injection axis 312, into the combustion liner 112, thereby forming a secondary combustion zone 160. The combined hot gases 26 from the primary and secondary combustion zones travel downstream through the aft end 118 of the combustor can 24 and into the turbine section, where the combustion gases 26 are expanded to drive the turbine 28.

Notably, to increase the operability of the combustor 24 with different fuels, it is desirable for the fuel injector 300 to function with both gaseous and liquid fuels 20, 21, separately or simultaneously. The fuel injector 300 may operate on a single fuel at a time (e.g., only on the gaseous fuel 20 or the liquid fuel 21) or may co-fire, simultaneously introducing both the gaseous fuel 20 and the liquid fuel 21 into the secondary combustion zone 160. The fuel injector 300 and/or the fuel supply lines 202, 204 may be protected from damage by a protective cover 206. Alternately, the protective cover 206 may surround only the fuel injector 300 and may include a plurality of orifices (not shown) to condition the flow of air 18 into the fuel injector 300.

Figure 3:
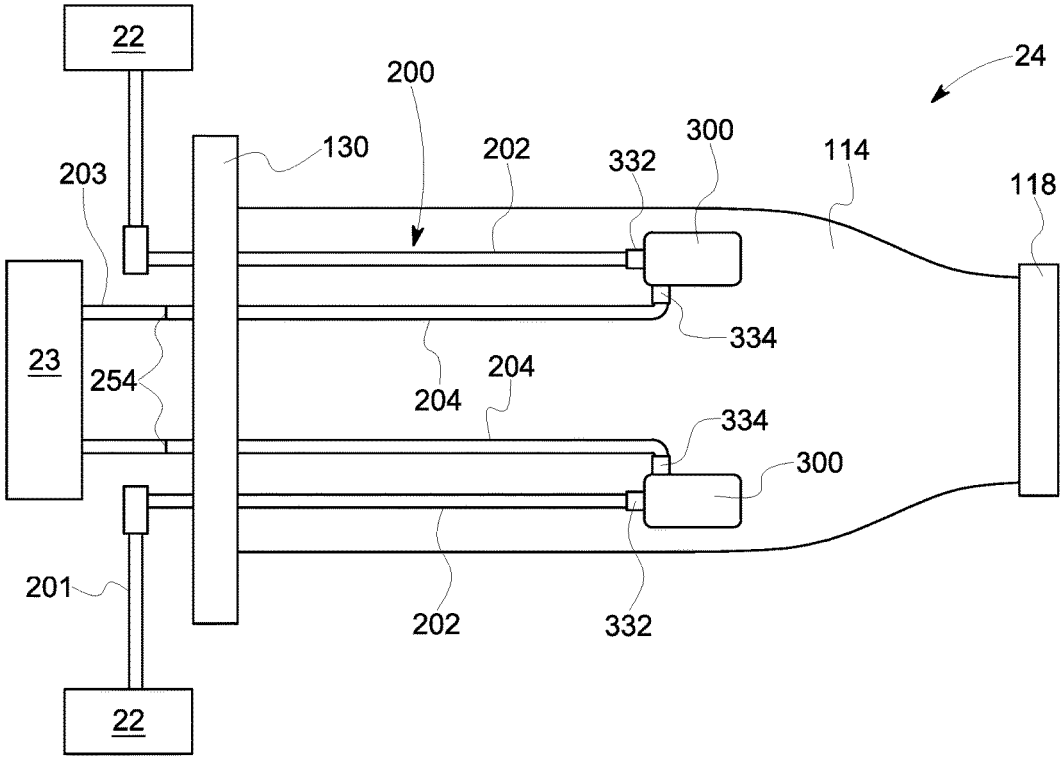
FIG. 3 is an overhead plan view of a portion of the combustor of FIG. 2.

FIG. 3 illustrates an exemplary arrangement for supplying the gaseous fuel 20 and the liquid fuel 21 to the fuel injector 300. The gaseous fuel 20 from the gaseous fuel supply 22 may be conveyed through an upstream gaseous fuel conduit or manifold 201, which is fluidly coupled to the gaseous fuel supply line 202. The gaseous fuel supply line 202 is joined to a respective gaseous fuel conduit fitting 332 of the fuel injector 300.

The liquid fuel 21 from the liquid fuel supply 23 may be conveyed through an upstream liquid fuel conduit or manifold 203, which is fluidly coupled to the liquid fuel supply line 204. The liquid fuel supply line 204 is joined to a respective liquid fuel conduit fitting 334 of the fuel injector 300. The liquid fuel 21 manifold 203 may be cooled by water to reduce the likelihood of coking.

For ease of installation and to minimize the height of the AFS system 200, the fuel supply lines 202, 204 are spaced circumferentially apart from one another, although other arrangements may instead be employed for the same purpose. For instance, the fuel supply line 204 may be disposed concentrically within the fuel supply line 202.

FIGS. 4 through 15 illustrate various embodiments of the fuel injector 300, which may be employed in the AFS system 200. To differentiate between fuel injectors with various features, the fuel injectors are labeled herein and in the accompanying drawings with letters (e.g., a, b, c, etc.) as well as the number 300. It should be understood that any fuel injector 300 may be used in the combustors 24 shown in FIGS. 1, 2, and 3. Like features will otherwise be referred to with common numeric designations to the extent possible.

Figure 4:
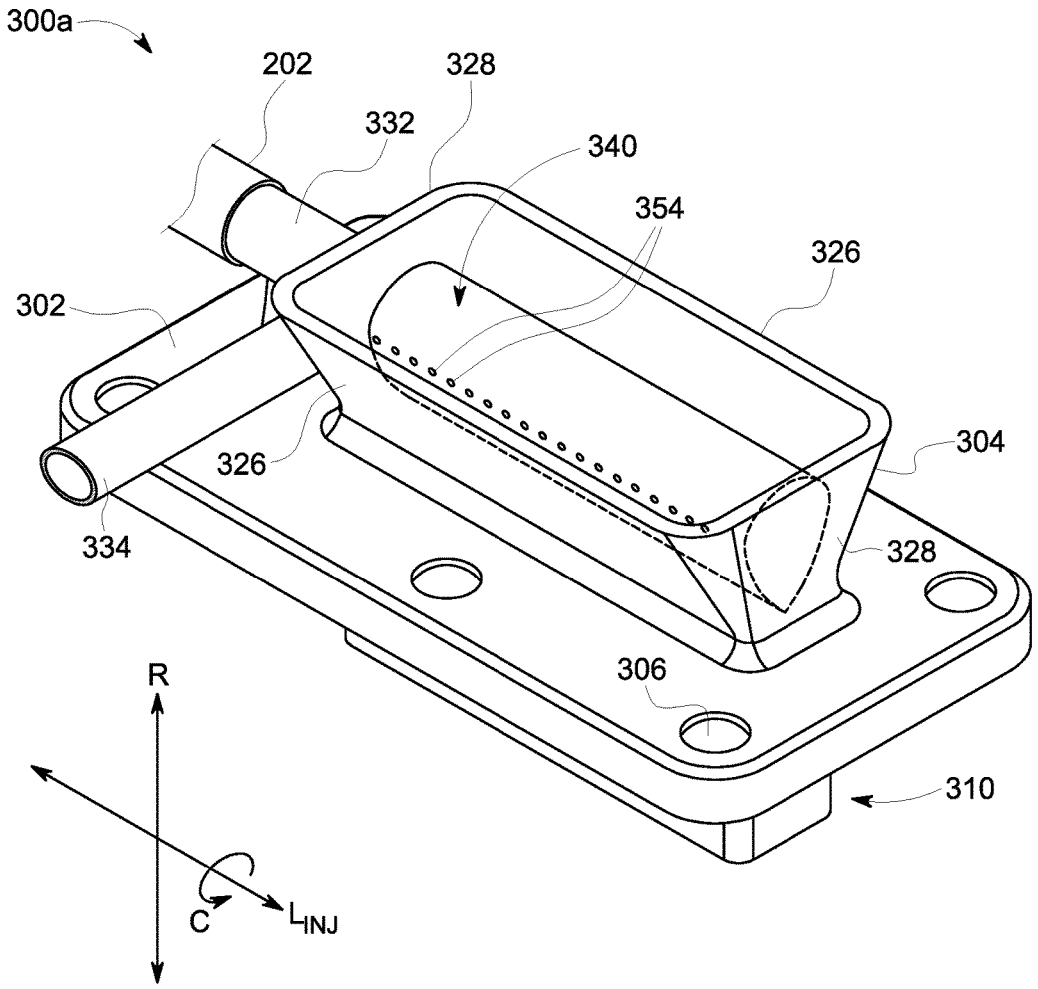
FIG. 4 is a perspective view of a fuel injector, according to one aspect of the present disclosure.
Figure 5:
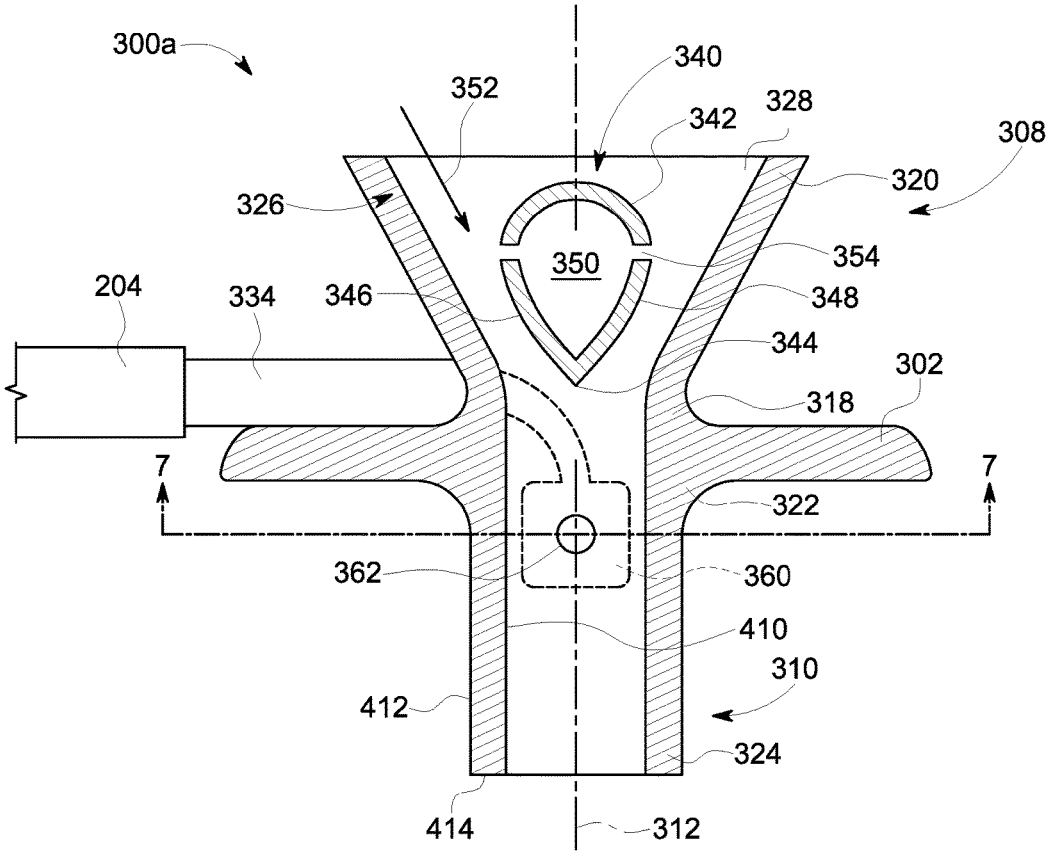
FIG. 5 is a cross-sectional view of the fuel injector of FIG. 4.
Figure 6:
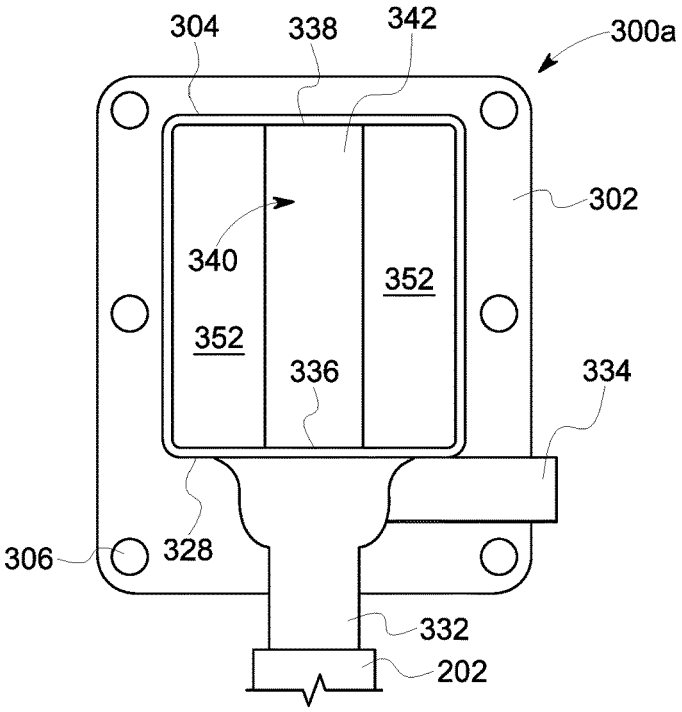
FIG. 6 is an overhead view of the fuel injector of FIG. 4.
Figure 7:
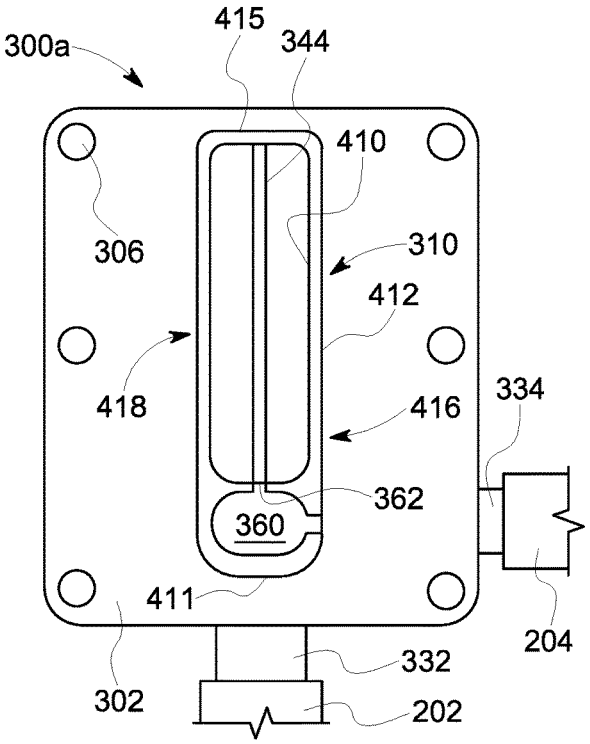
FIG. 7 is a cross-sectional elevation view of an outlet portion of the fuel injector of FIG. 4, as taken along 7-7 of FIG. 5.

FIGS. 4 through 7 specifically illustrate an exemplary fuel injector 300*a* for use in the AFS system 200 described above, according to one aspect of the present disclosure. FIG. 4 is a perspective view of the fuel injector 300*a*. FIG. 5 is a cross-sectional view of the fuel injector 300*a* of FIG. 4. FIG. 6 is an overhead plan view of the fuel injector 300*a* of FIG. 4, while FIG. 7 is a cross-sectional elevation view of an outlet portion of the fuel injector 300*a* of FIG. 4.

In the exemplary embodiment, the fuel injector 300*a* includes a mounting flange 302, a frame 304, and an outlet member 310 that are coupled together. In one embodiment, the mounting flange 302, the frame 304, and the outlet member 310 are manufactured as a single-piece structure (that is, are formed integrally with one another). Alternately, in other embodiments, the flange 302 may not be formed integrally with the frame 304 and/or the outlet member 310 (e.g., the flange 302 may be coupled to the frame 304 and/or the outlet member 310 using a suitable fastener). Moreover, the frame 304 and the outlet member 310 may be made as an integrated, single-piece unit, which is separately joined to the flange 302, e.g., by permanent means (such as welding) or by removable means (such as interlocking members or features).

The flange 302 is generally planar (i.e., "generally planar" meaning that the flange 302 may have a slight curvature in the circumferential direction complementary to the shape of the outer sleeve 114). The flange 302 defines a plurality of apertures 306 that are each sized to receive a fastener (not shown) for coupling the fuel injector 300*a* to the outer sleeve 114. The fuel injector 300*a* may have any suitable structure in lieu of, or in combination with, the flange 302 that enables the frame 304 to be coupled to the outer sleeve 114, such that the fuel injector 300*a* functions in the manner described herein.

The frame 304 defines an inlet portion 308 of the fuel injector 300*a* and is a carrier of at least one fuel injection body 340, as will be discussed further herein. The frame 304 includes a first pair of oppositely disposed side walls 326 and a second pair of oppositely disposed end walls 328 that connect the side walls 326. The side walls 326 are longer than the end walls 328, thus providing the frame 304 with a generally rectangular profile in the axial direction. The frame 304 has a generally trapezoid-shaped profile in the radial direction (that is, side walls 326 are angled with respect to the flange 302).

As shown in FIG. 5, the frame 304 has a first end 318 proximal to the flange 302 ("a proximal end") and a second end 320 distal to the flange 302 ("a distal end"). The first ends 318 of the side walls 326 are spaced further from a longitudinal axis of the fuel injector 300 ($L_{INJ}$) than the second ends of the side walls 326, when compared in their respective longitudinal planes. In one exemplary embodiment, the distal end 320 of inlet member 308 may be wider than the proximal end 318 of the frame 304, such that the frame 304 is at least partly tapered (or funnel-shaped) between the distal end 320 and the proximal end 318. Said differently, in the exemplary embodiment described above, the sides 326 may converge in thickness from the distal end 320 to the proximal end 318.

The outlet member 310 extends radially from the flange 302 on a side opposite the frame 304. The outlet member 310 defines a uniform, or substantially uniform, cross-sectional area in the radial and axial directions. The outlet member 310 provides fluid communication between the frame 304 and the interior of the liner 112 and delivers the second fuel/air mixture 156 along an injection axis 312 (shown in FIG. 5) into the secondary combustion zone 160. The outlet member 310 has a first end 322 proximal to the flange 302 and a second end 324 distal to the flange 302 (and proximal to the liner 112), when the fuel injector 300 is installed. Further, when the fuel injector 300 is installed, the outlet member 310 is located within the annulus 132 between the liner 112 and the outer sleeve 114, such that the flange 302 is located on an outer surface of the outer sleeve 114 (as shown in FIGS. 2 and 3).

Although the injection axis 312 is generally linear in the exemplary embodiment, the injection axis 312 may be non-linear in other embodiments. For example, the outlet member 310 may have an arcuate shape in other embodiments (not shown). The injection axis 312 represents a radial dimension "R" with respect to the longitudinal axis 170 of the combustion can 10 ($L_{COMB}$). The fuel injector 300*a* further includes a longitudinal dimension (represented as axis $L_{INJ}$), which is generally perpendicular to the injection axis 312, and a circumferential dimension "C" extending about the longitudinal axis $L_{INJ}$.

Thus, the frame 304 extends radially from the flange 302 in a first direction, and the outlet member 310 extends radially inward from the flange 302 in a second direction opposite the first direction. The flange 302 extends circumferentially around (that is, circumscribes) the frame 304. The frame 304 and the outlet member 310 extend circumferentially about the injection axis 312 and are in flow communication with one another across the flange 302.

Although the embodiments illustrated herein present the flange 302 as being located between the frame 304 and the outlet member 310, it should be understood that the flange 302 may be located at some other location or in some other suitable orientation. For instance, the frame 304 and the outlet member 310 may not extend from the flange 302 in generally opposite directions.

In the exemplary embodiment, the fuel injector 300*a* further includes a gaseous fuel conduit fitting 332 in fluid communication with the fuel injection body 340. As shown, the gaseous fuel conduit fitting 332 is formed integrally with one of the end walls 328 of the frame 304, such that the gaseous fuel conduit fitting 332 extends generally outward along the longitudinal axis ($L_{INJ}$) of the injector 300. The gaseous fuel conduit fitting 332 is connected to the gaseous fuel supply line 204 and receives gaseous fuel 20 therefrom. The gaseous fuel conduit fitting 332 may have any suitable size and shape, and may be formed integrally with, or coupled to, any suitable portion(s) of the frame 304 that enable the conduit fitting 332 to function as described herein (e.g., the conduit fitting 332 may be formed integrally with a side wall 326 in some embodiments).

The fuel injection body 340 has a first end 336 that is formed integrally with the end wall 328 from which the gaseous fuel conduit fitting 332 projects and a second end 338 that is formed integrally with the end wall 328 on the opposite end of the fuel injector 300*a*. The fuel injection body 340, which extends generally linearly across the frame 304 between the end walls 328, defines an internal fuel chamber 350 (shown in FIG. 5) that is in fluid communication with the conduit fitting 332. In other embodiments, the fuel injection body 340 may extend across the frame 304 from any suitable portions of the frame 304 that enable the fuel injection body 340 to function as described herein (e.g., the fuel injection body 340 may extend between the side walls 326). Alternately, or additionally, the fuel injection body 340 may define an arcuate shape between oppositely disposed walls (326 or 328).

As mentioned above, the fuel injection body 340 has a plurality of surfaces that form a hollow structure that defines the internal fuel chamber 350 and that extends between the end walls 328 of the frame 304. When viewed in a cross-section taken perpendicular to the longitudinal axis $L_{INJ}$, as shown in FIG. 5, the fuel injection body 340 (in the present embodiment) generally has the shape of an inverted teardrop with a curved leading edge 342, an oppositely disposed trailing edge 344, and a pair of opposing fuel injection surfaces 346, 348 that extend from the leading edge 342 to the trailing edge 344. The fuel chamber 350 does not extend into the flange 302 or within the frame 304 (other than the fluid communication through the end wall 328 into the conduit fitting 332).

The fuel injection body 340 is oriented such that the leading edge 342 is proximate the distal end 320 of the side walls 326 (i.e., the leading edge 342 faces away from the proximal end 318 of the side walls 326). The trailing edge 344 is located proximate the proximal end 318 of the side walls 326 (i.e., the trailing edge 344 faces away from the distal end 320 of the side walls 326). Thus, the trailing edge 344 is in closer proximity to the flange 302 than is the leading edge 342.

Each fuel injection surface 346, 348 faces a respective interior surface 330 of the side walls 326, thus defining a pair of flow paths 352 (visible in FIG. 6) that intersect with one another downstream of the trailing edge 344 and upstream of, or within, the outlet member 310 (FIG. 5). While the flow paths 352 are shown as being of uniform dimensions from the distal end 320 of the frame 304 to the proximal end 318 of the frame 304, it should be understood that the flow paths 352 may converge from the distal end 320 to the proximal end 318, thereby accelerating the flow.

Each fuel injection surface 346, 348 includes a plurality of fuel injection ports 354 that provide fluid communication between the internal chamber 350 and the flow paths 352. The fuel injection ports 354 are spaced along the length of the fuel injection surfaces 346, 348 (see FIG. 2), for example, in any manner (e.g., one or more rows) suitable to enable the fuel injection body 340 to function as described herein.

Further, as shown in FIGS. 4 and 5, the side walls 326 of the frame 304 are oriented at an angle with respect to the flange 302, thus causing the frame 304 to converge from the distal end 320 to the proximal end 318 of the side walls 326. In some embodiments, the end walls 328 may also or instead be oriented at an angle with respect to the flange 302. The side walls 326 and the end walls 328 have a generally linear cross-sectional profile. In other embodiments, the side segments 326 and the end segments 328 may have any suitable cross-sectional profile(s) that enables the frame 304 to be at least partly convergent (i.e., tapered) between distal end 320 and proximal end 318 (e.g., at least one side wall 326 may have a cross-sectional profile that extends arcuately between ends 320 and 318). Alternatively, the frame 304 may not taper between ends 320 and 318 (e.g., in other embodiments, when the side walls 326 and the end walls 328 may each have a substantially linear cross-sectional profile that are oriented substantially parallel to injection axis 312).

FIG. 7 provides a cross-sectional elevation view of the outlet member 310 of the fuel injector 300, as taken along line 7-7 of FIG. 5. The outlet member 310 is provided with a leading edge 411, a trailing edge 415, a first outlet side wall 416, and a second outlet side wall 418. The outlet side walls 416, 418 are longer than the leading edge 411 or the trailing edge 415, thereby imparting a generally elongate shape to the outlet member 310. Although the leading edge 411 and the trailing edge 415 are shown as being relatively linear, it should be understood that one or both of these edges 411 and 415 may be arcuate or curved instead. Further, while the leading edge 411 and the trailing edge 415 are shown as being of approximately equal length, it should be understood that one of the leading edge 411 and the trailing edge 415 may be longer than the opposing edge (415 or 411, respectively), thereby causing the outlet member 310 to taper in the longitudinal direction (along $L_{INJ}$).

The outlet member 310 includes an inner surface 410, an outer surface 412, and a bottom surface 414 (shown in FIG. 5). The inner surface 410, the outer surface 412, and the bottom surface 414 at least partially define a liquid fuel mixture plenum 360, which is in fluid communication with the liquid fuel conduit fitting 334. The liquid fuel mixture plenum 360 houses a mixture of liquid fuel and water, which are received from the liquid fuel supply line 204. The liquid fuel mixture plenum 360 delivers a mixture of water and liquid fuel 20 to a liquid fuel mixture injection port 362, which is downstream of the trailing edge 344 of the (gaseous) fuel injection body 340. The liquid fuel mixture plenum 360 and the corresponding liquid fuel mixture injection port 362 are located along a leading edge 411 of the outlet member 310, the leading edge 411 being defined as an upstream (or leading) portion of the outlet member 310 relative to the flow of combustion products 26 through the liner 112.

Figure 8:
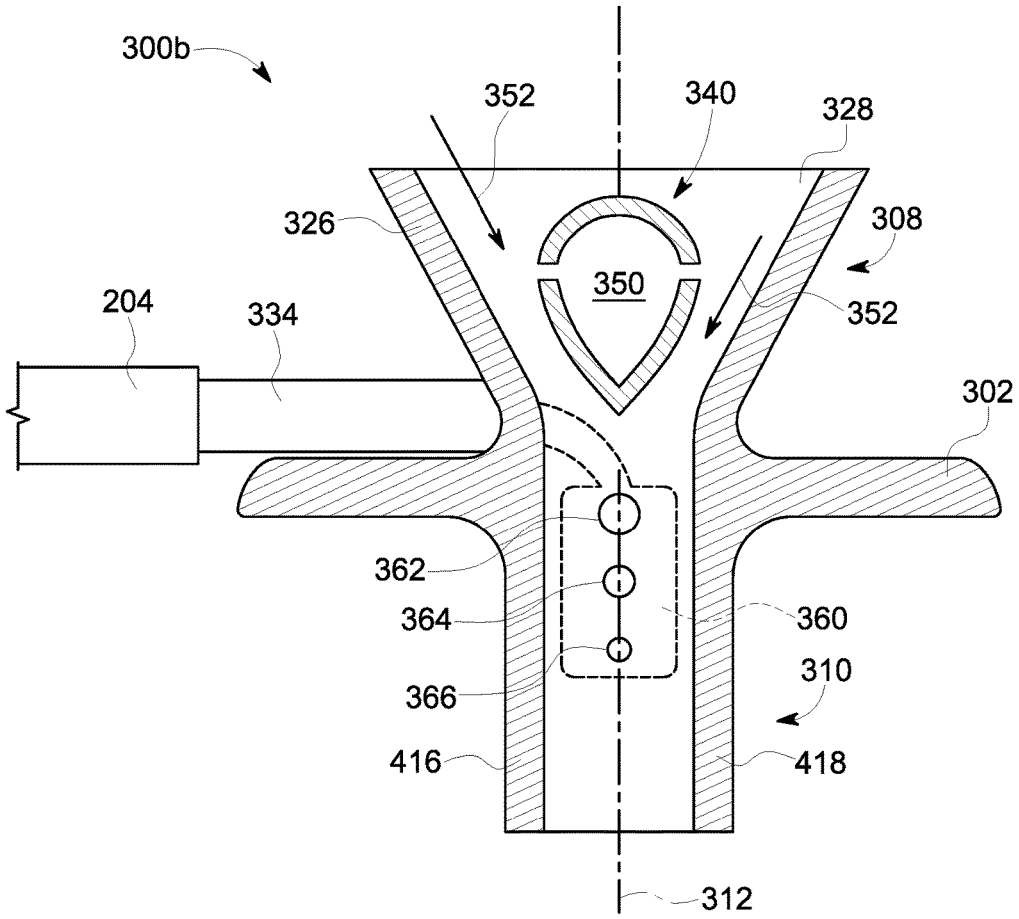
FIG. 8 is a cross-sectional view of a fuel injector, according to another aspect of the present disclosure.

FIG. 8 illustrates an alternate configuration for injecting a mixture of liquid fuel and water into the outlet member 310. In this configuration, a fuel injector 300*b* is provided with a second liquid fuel mixture injection port 364 and a third liquid fuel mixture injection port 366, which are positioned downstream of the liquid fuel mixture injection port 362. In one embodiment, as shown, the (first) liquid fuel mixture injection port 362 has a larger diameter than the second liquid fuel mixture injection port 364, and the second liquid fuel mixture injection port 364 has a larger diameter than the third liquid fuel mixture injection port 366. Using liquid fuel mixture injection ports 362, 364, 366 of different and decreasing diameters produces spray arcs of different lengths and delivers different flow volumes to the outlet member 310, which may promote mixing of the liquid fuel/water mixture with the air 18 flowing through the flow paths 352.

Figure 9:
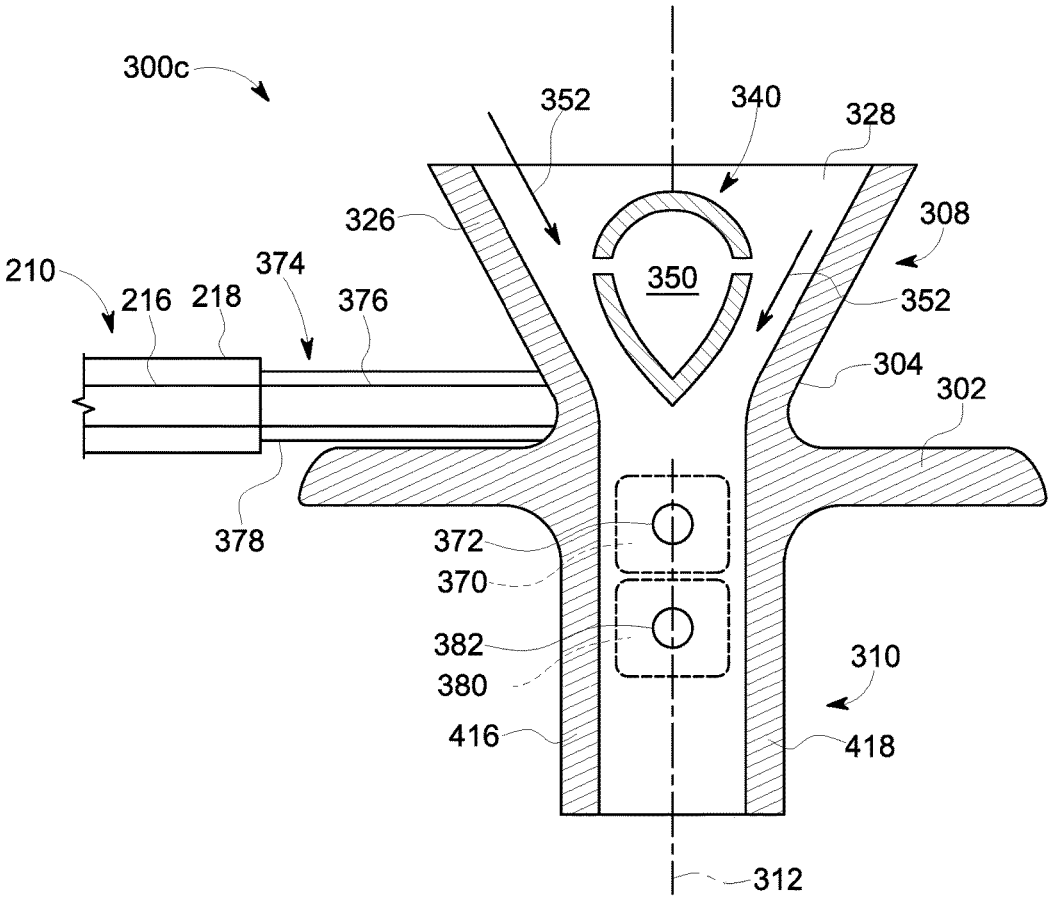
FIG. 9 is a cross-sectional view of a fuel injector, according to yet another aspect of the present disclosure.
Figure 10:
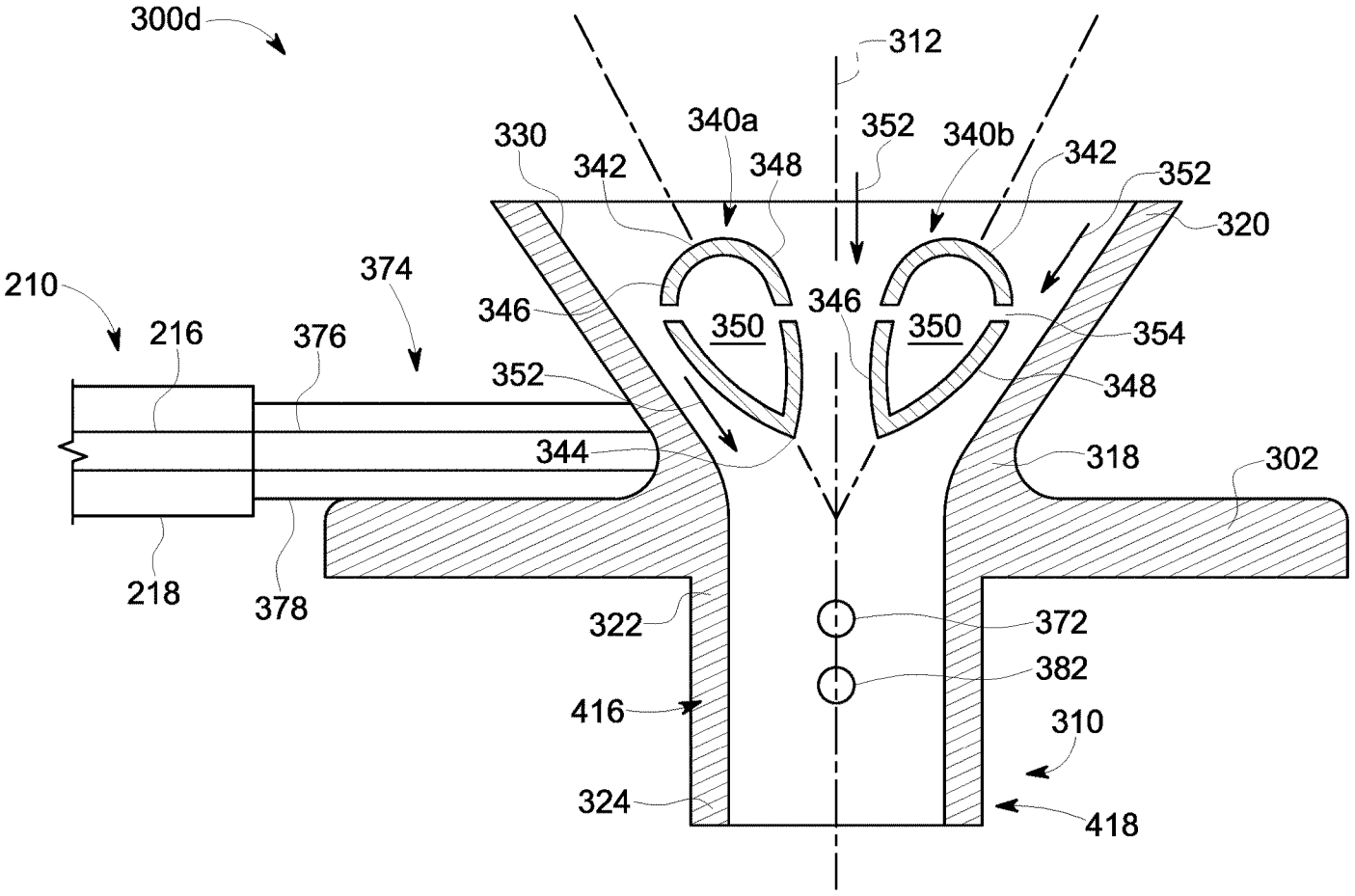
FIG. 10 is a cross-sectional view of a fuel injector, according to one aspect of the present disclosure.

FIGS. 9 and 10 illustrate additional configurations of the present disclosure, in which liquid fuel 21 and water are injected separately into the outlet member 310. FIG. 9 illustrates a fuel injector 300*c* having a single fuel injection body 340, and FIG. 10 illustrates a fuel injector 300*d* having a pair of fuel injection bodies 340*a*, 340*b*.

In these embodiments, the liquid fuel supply line 204 is replaced by a tube-in-tube assembly 210, in which a liquid fuel supply line 216 is surrounded a water supply line 218. Similarly, the liquid fuel conduit fitting 334 is replaced by a conduit-in-conduit fitting 374, in which a liquid fuel conduit 376 is disposed within a water conduit 378. The liquid fuel conduit 376 is disposed in fluid communication with the liquid fuel plenum 380, which feeds the liquid fuel injection port 382. The water conduit 378 is disposed in fluid communication with a water plenum 370, which feeds a fluid injection port 372.

In an alternate embodiment, the water supply line 218 and the water conduit 378 may be replaced by an air supply line and an air conduit (not shown separately, but structurally identical), which is in fluid communication with a source of compressed air 18.

By using concentric tubes 210 and fittings 374, the risk of damage due to a liquid fuel leak is minimized. In the unlikely event of a liquid fuel leak, the leaked liquid fuel is contained within the outermost tube 218 or fitting 378 and subsequently conveyed into the fuel injector 300*c*, 300*d*. If desired, sensors may be used to monitor the pressure of the liquid fuel supply line 216 and/or the water supply line 218 to detect a leak in the liquid fuel supply line 216 and/or the water supply line 218, respectively, that may impact performance of the injector 300*c*, 300*d*.

In one embodiment, as illustrated, both the liquid fuel injection port 382 and the fluid injection port 372 are located downstream of the trailing edge 344 of the fuel injection body 340. In some instances, it may be desirable to minimize the distance between the fuel injection port 382 and the trailing edge 344 to maximize the mixing time of the liquid fuel 21 and air 18 within the outlet member 310, as well as to achieve greater penetration of the droplets of liquid fuel 21 into the traversing air stream.

In one illustrated embodiment, the fluid injection port 372 is shown as being upstream of the liquid fuel injection port 382, which may help to minimize coking at the fuel injection port 362. However, in other instances, the fluid injection port 372 may be disposed downstream of the liquid fuel injection port 382.

In the exemplary embodiment of FIGS. 9 and 10, the water injection port 372 and the liquid fuel injection port 382 are shown as having diameters of equal size. However, in other instances, the fluid injection port 372 may be smaller or larger than the liquid fuel injection port 382.

In the exemplary embodiment of FIGS. 9 and 10, a single fluid injection port 372 is located upstream of a single liquid fuel injection port 382. However, in other instances, more than one fluid injection port 372 may be employed upstream of one or more fuel injection ports 382. In yet other instances, the fluid injection port 372 may be employed upstream of more than one liquid fuel injection ports 382. It is contemplated that, when multiple injection ports are used, the ports 372 and/or 382 may be arranged in a radial direction or in a circumferential direction (e.g., about the leading edge 411 of the outlet member 310 or about the perimeter of the outlet member 310).

As shown in FIG. 10, the inlet portion 308 of the fuel injector 300*d* may include more than one fuel injection body 340 (that is, fuel injection bodies 340*a*, 340*b*) extending across the frame 304 in any suitable orientation that defines a suitable number of flow paths 352. For example, in the embodiment shown in FIG. 10, the fuel injector 300*d* includes a pair of adjacent fuel injection bodies 340*a*, 340*b* that define three spaced flow paths 352 within the frame 304. In one embodiment, the flow paths 352 are equally spaced, as results from the fuel injection bodies 340*a*, 340*b* being oriented at the same angle with respect to the injection axis 312. Each fuel injection body 340*a*, 340*b* includes a plurality of fuel injection ports 354 on at least one fuel injection surface 346 or 348, as described above, such that the fuel injection ports 354 are in fluid communication with a respective fuel chamber 350 defined within each fuel injection body 340*a*, 340*b*. In turn, the fuel chambers 350 are in fluid communication with the conduit fitting 332, which receives gaseous fuel 20 from the gaseous fuel supply line 202.

Figure 11:
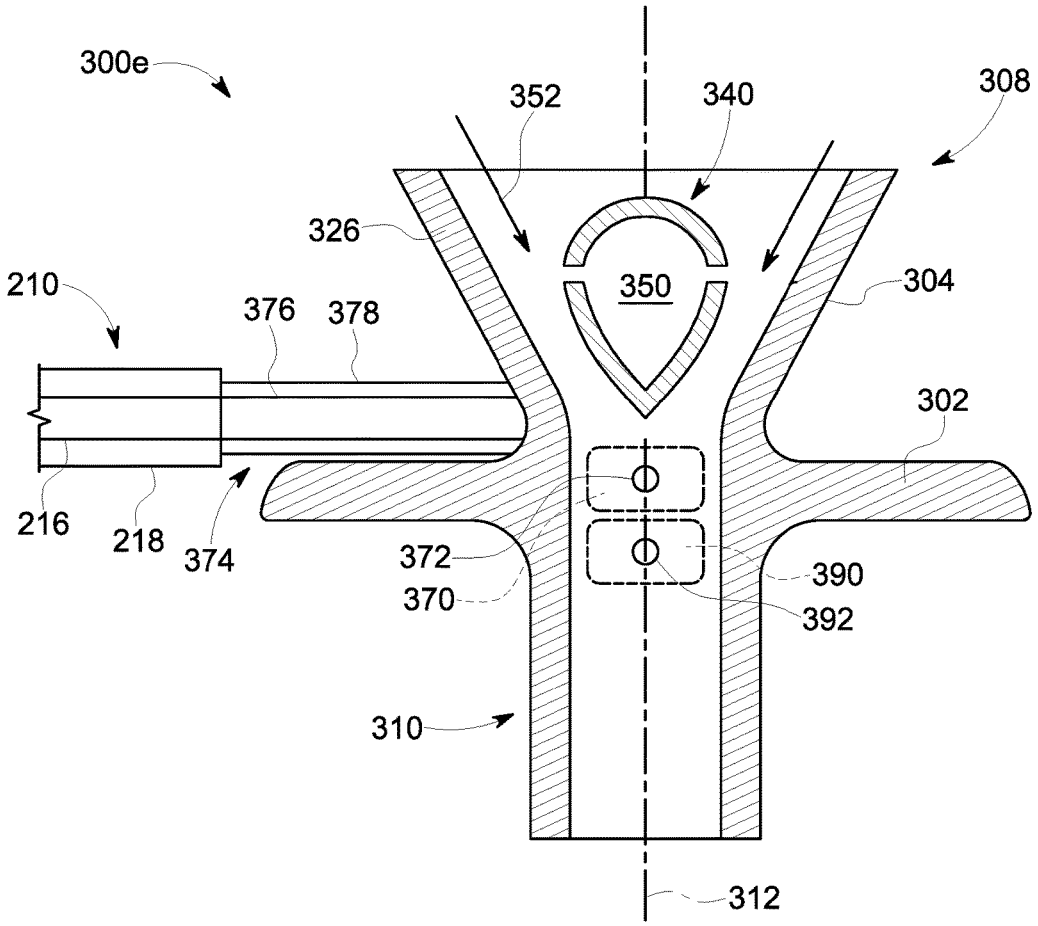
FIG. 11 is a cross-sectional view of a fuel injector, according to another aspect of the present disclosure.
Figure 12:
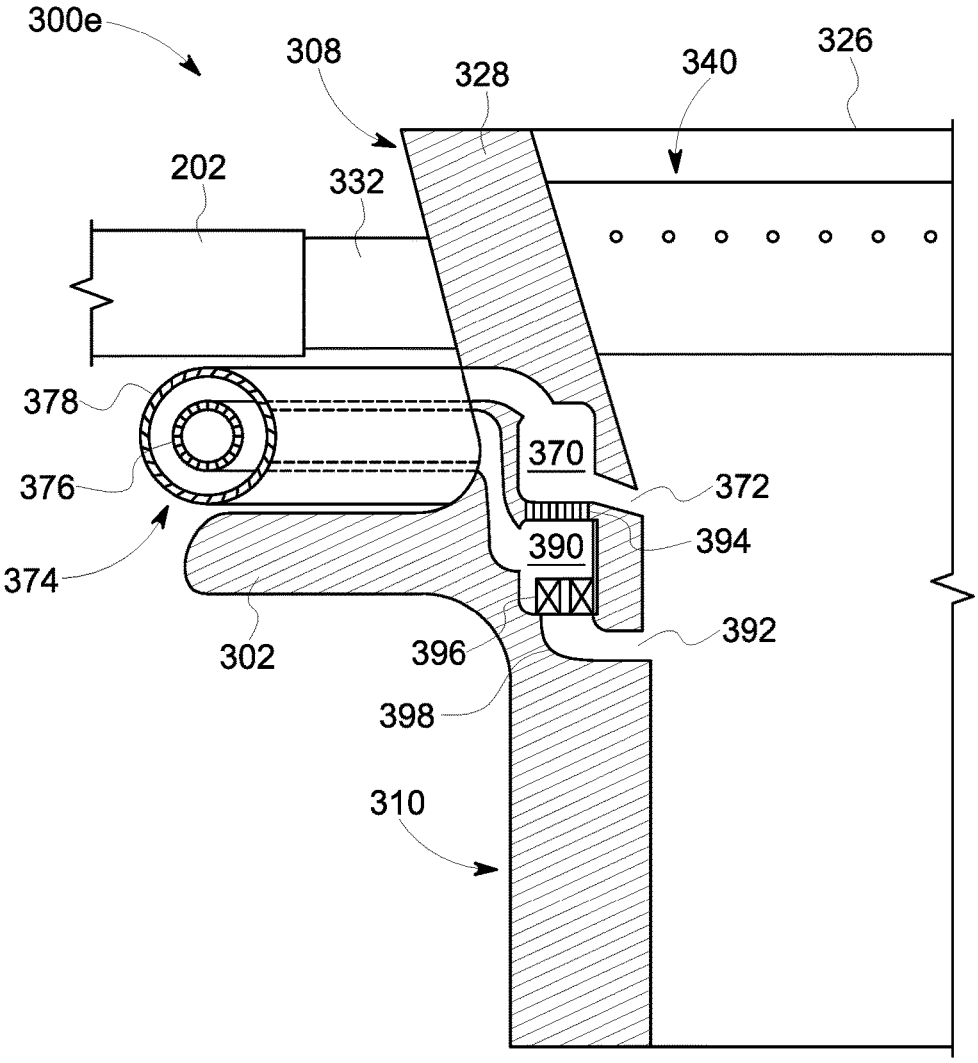
FIG. 12 is an enlarged cross-sectional view of a portion of the fuel injector of FIG. 11, as taken along a longitudinal plane of the injector.

FIG. 11 and FIG. 12 illustrate a fuel injector 300*e*, in which the end wall 328 of the frame 304 and/or the mounting flange 302 define therein the water plenum 370 and a mixing plenum 390 in which water and liquid fuel are mixed prior to injection. Water is injected from the water plenum 370 via one or more fluid injection ports 372. A mixture of liquid fuel and water is injected from the mixing plenum 390 via one or more liquid fuel mixture injection ports 392.

Within the end wall 328 of the fuel injector 300*e*, a flow restrictor 394 restricts the liquid fuel in the mixing plenum 390 from flowing into the water plenum 370 and being injected through the fluid injection port(s) 372. Water from the water conduit 378 flows into both the water plenum 370 and the mixing plenum 390. Liquid fuel flows from the liquid fuel conduit 376 into the mixing plenum 390, where it mixes with water. A mixing device 396 located within the mixing plenum 390 promotes the mixing of the liquid fuel and water, as does a curve, or elbow, 398 located between the mixing device 396 and the liquid fuel mixture injection port(s) 392.

In the exemplary embodiment, the fluid injection port 372 is upstream of the liquid fuel mixture injection ports 392. By introducing water upstream of the liquid fuel—and, in some embodiments, prior to the introduction of the liquid fuel mixture—the temperature of the air flowing through the inlet portion 308 of the fuel injector 300*e* and the temperature of the surfaces of the fuel injector 300*e* are reduced, thereby mitigating the risk of auto-ignition of the liquid fuel mixture. Additionally, the water may produce a film along the inner surfaces of the walls 326, 328 and the outlet member 310, thus reducing the propensity of the liquid fuel to coke along the inner surfaces.

Figure 13:
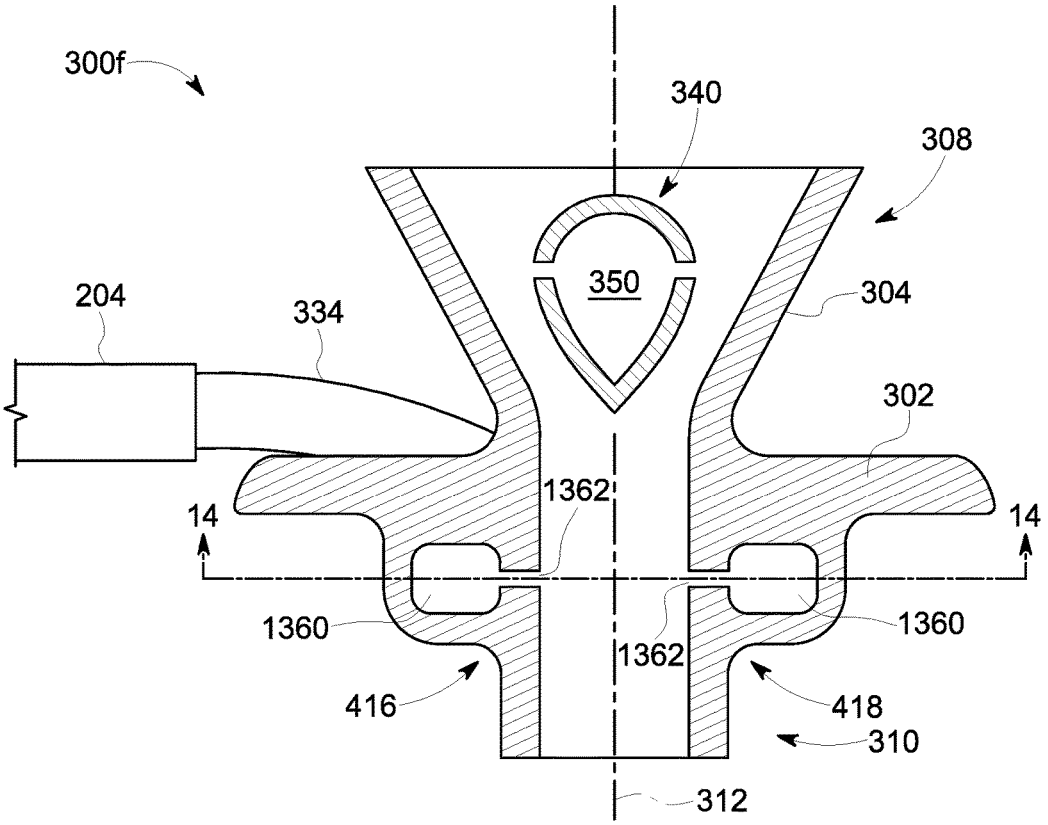
FIG. 13 is a cross-sectional view of a fuel injector, according to one aspect of the present disclosure.

FIG. 13 illustrates a fuel injector 300*f*, which is yet another variation of the fuel injector 300. In the fuel injector 300*f*, the liquid fuel mixture plenum 1360 is disposed within the outlet member 310, and circumscribes a portion, or all, of the outlet member 310. For example, the liquid fuel plenum 360 may extend along the leading edge 411, the outlet side walls 416, 418, and the trailing edge 415. The liquid fuel mixture plenum 360 is in fluid communication with the liquid fuel conduit fitting 334.

A mixture of liquid fuel and water is injected from the liquid fuel mixture plenum 1360, via a plurality of liquid fuel mixture injection ports 1362 distributed circumferentially along the inner surface 410 of the outlet member 310. The inlet portion 308 of the fuel injector 300 may include a single fuel injection body 340, as shown, or more than one fuel injection body (e.g., 340*a*, 340*b*), as shown in FIG. 10.

Figure 14:
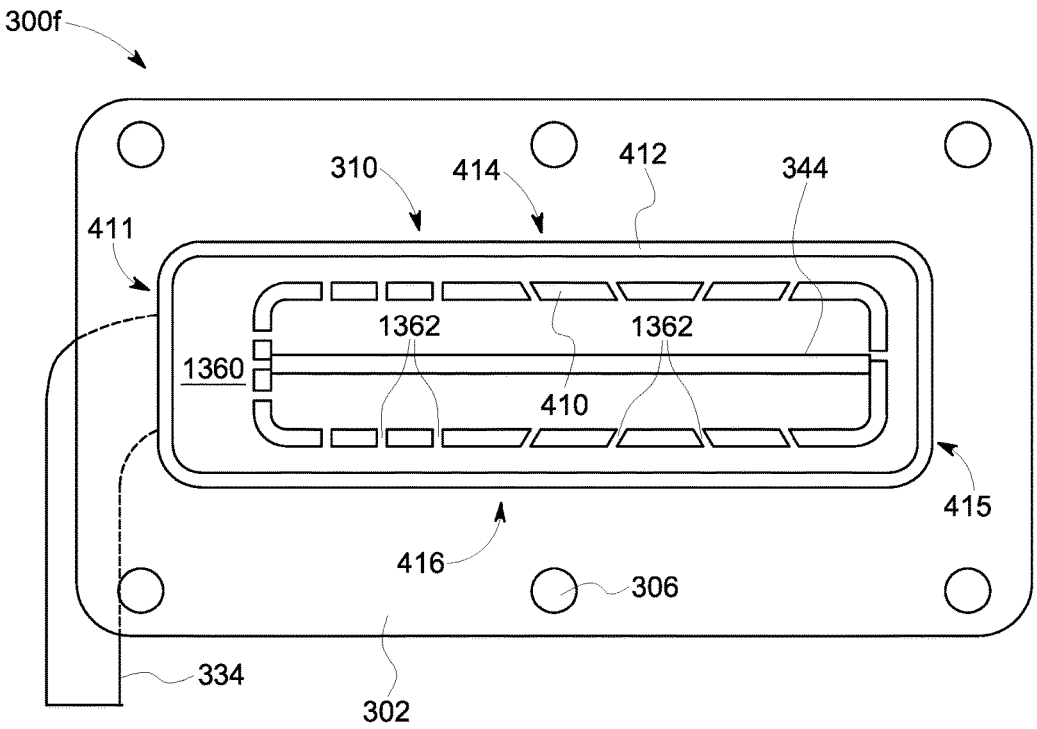
FIG. 14 is a cross-sectional elevation view of an outlet portion of a fuel injector, as taken along line 14-14 of FIG. 12, according to another aspect of the present disclosure.

FIG. 14 is a cross-sectional elevation view of the outlet member 310 of the fuel injector 300*f* of FIG. 13, as taken along line 14-14. The liquid fuel mixture injection ports 1362 are disposed about the outlet member 310 in fluid communication with the liquid fuel mixture plenum 1360. A greater concentration of liquid fuel mixture injection ports 1362 may be oriented toward the leading edge 411 of the outlet member 310, as shown. Fewer and/or smaller fuel liquid fuel mixture injection ports 1362 may be disposed along the sides and the trailing edge 415 of the outlet member 310. Alternately, the liquid fuel mixture injection ports 1362 may be distributed uniformly about the circumference of the outlet member 310.

Figure 15:
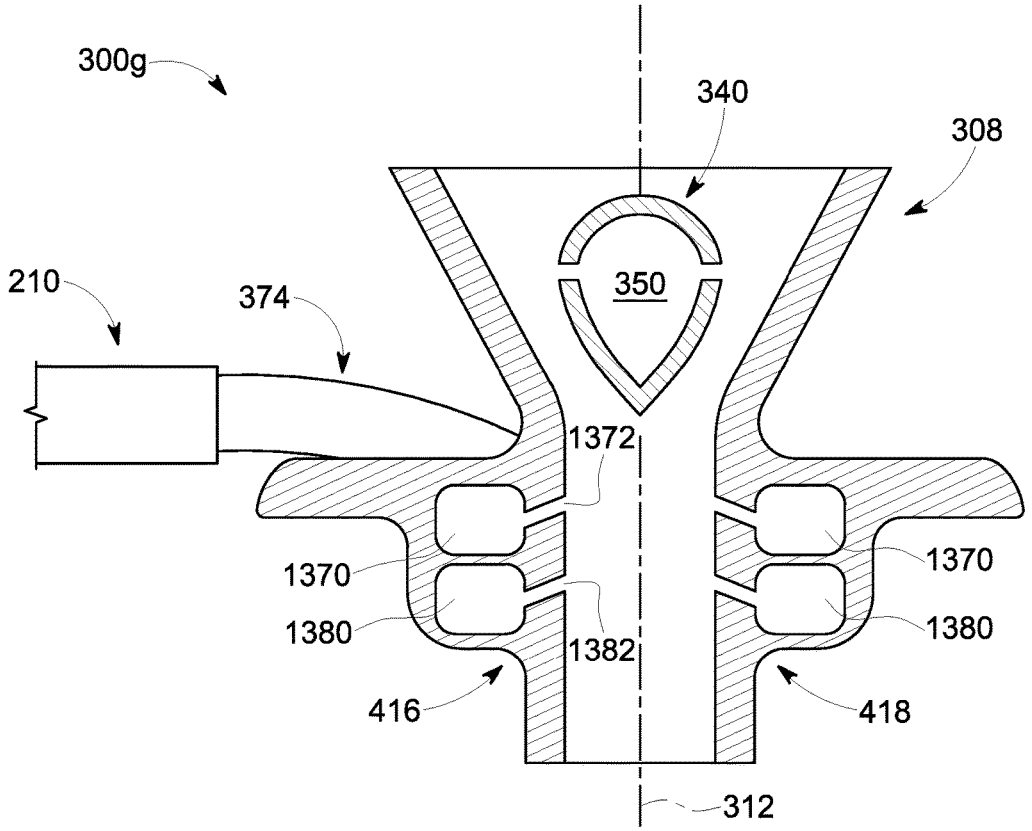
FIG. 15 is a cross-sectional view of a fuel injector, according to yet another aspect of the present disclosure.

FIG. 15 is a cross-sectional view of a fuel injector 300*g*. In this configuration, a liquid fuel plenum 1380 and the water plenum 1370 are positioned along the side wall 416 and/or the side wall 418 of the outlet member 310. The liquid fuel plenum 1380 may feed one or more liquid fuel injection ports 1382 along a circumferential portion of the outlet member 310. Similarly, the water plenum 1370 may feed one or more fluid injection ports 1372 along the same circumferential portion of the outlet member 310. The injection ports 1372 and/or 1382 may direct the flow perpendicularly (i.e., "normal") to the inner surface 410 of the outlet member 310 or, as shown, may direct the flow at a non-right angle ("angled" or "oblique") relative to the inner surface 410 of the outlet member 310. The ports 1372 and/or 1382 may be angled in an upstream direction or a downstream direction, relative to the flow of air through the inlet portion 308 of the fuel injector 300*g*. The ports 1372 may be oriented at a first angle (including normal), which is different from the orientation of the ports 1382. Alternately, the ports 1372 and/or 1382 in different portions of the outlet member 310 may be oriented at angles different from other ports 1372 and/or 1382, respectively.

While FIG. 15 illustrates the water plenum 1370 and the liquid fuel plenum 1380 as being located along both side walls 416, 418 of the outlet member 310, it should be understood that the water plenum 1370 and the liquid fuel plenum 1380 may be located along a single side wall 416 or 418. It should further be understood that the water plenum 1370 and the liquid fuel plenum 1380 may further be disposed along, or within, one or more of the leading edge wall 411 and the trailing edge wall 415. In other words, the water plenum 1370 and the liquid fuel plenum 1380 may be disposed within the circumference of the outlet member 310 with corresponding injection ports 1372, 1382 being spaced uniformly or non-uniformly (e.g., biased toward the leading edge wall 411), as discussed above.

Figure 16:
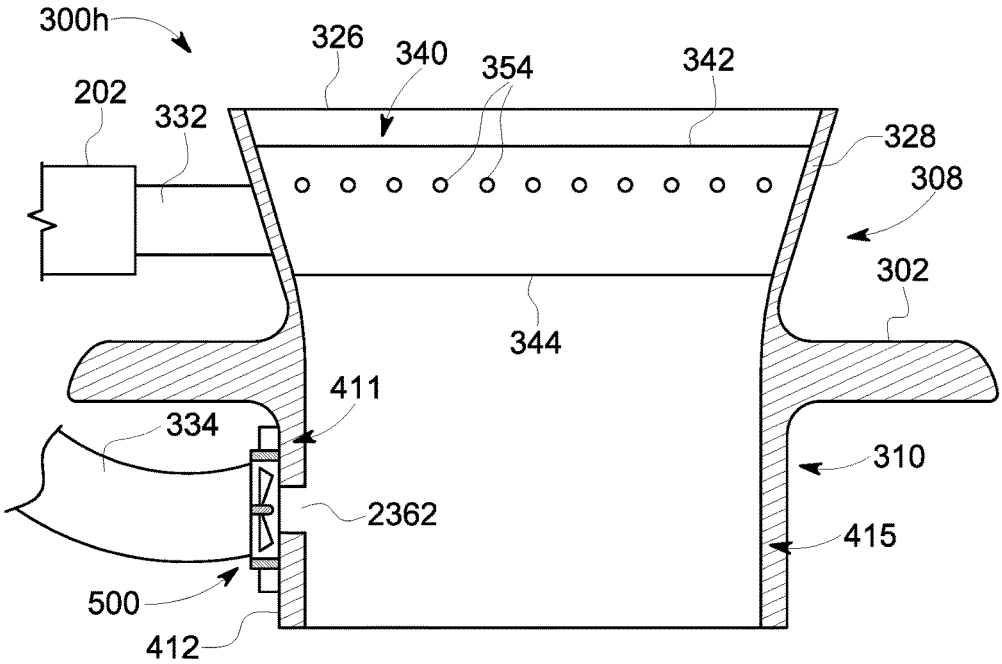
FIG. 16 is a cross-sectional view of a fuel injector, according to one aspect of the present disclosure.
Figure 17:
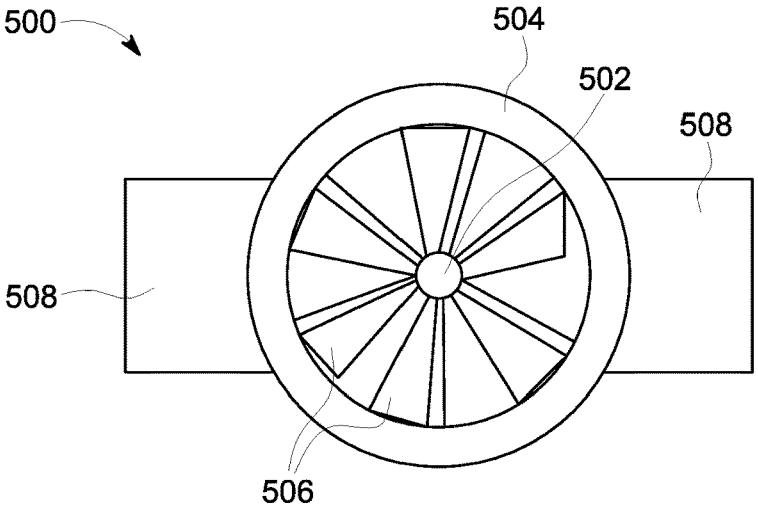
FIG. 17 is a plan view of a swirler assembly useful with the fuel injector of FIG. 16.

FIG. 16 illustrates a fuel injector 300*h*, in which a liquid fuel/water mixture is conveyed by the liquid fuel mixture conduit fitting 334 through a swirler assembly 500 before injection. The swirler assembly 500 is affixed to the outer surface 412 of the leading edge 411 of the outlet member 310. The swirler assembly 500 (shown in FIG. 17) includes a central hub 502, which is circumscribed by a swirler housing 504. A plurality of airfoil-shaped swirl vanes 506 extends between the central hub 502 and the swirler housing 504. The swirl vanes 506 impart a swirling momentum to the liquid fuel/water mixture as the mixture is conveyed through a liquid fuel mixture injection port 2362. Radially outboard of the swirler housing 504 are a pair of mounting flanges 508 used to affix the swirler assembly 500 to the outlet member 310.

Referring now to the fuel injectors 300*a* through 300*h*, during certain operations of the combustion can 24, compressed gas 18 flows into the frame 340 and through the flow paths 352. When the fuel injector 300 (any of 300*a* through 300*h*) is operating on liquid fuel, liquid fuel 21 is provided to the fuel injector 300 as part of a liquid/water mixture, via the liquid fuel conduit fitting 334 supplied by the liquid fuel supply line 204, or as a separate delivery from the water, via a conduit-in-conduit assembly 374 having the liquid fuel conduit 376 supplied by a liquid fuel supply line 216 and the water conduit 378 supplied by a water supply line 218. The liquid fuel and water are injected into the outlet member 310 of the fuel injector 300 through one or more injection ports (e.g., 354, 362, 364, 366, 372, 1362, 1372, 1382, 2362). The liquid fuel is atomized by the compressed air 18 flowing through the frame 304 and is conveyed through the outlet member 310 and into the secondary combustion zone 160 within the combustor liner 112 (as shown in FIG. 2).

In a co-fire operation, gaseous fuel 20 is conveyed through the gaseous fuel supply line 202 and through the conduit fitting 332 to the internal fuel chamber(s) 350 of the one or more fuel injection bodies 340. Gaseous fuel 20 passes from the fuel chambers 350 through the fuel injection ports 354 on the fuel injection surfaces 346 and/or 348 of each fuel injection body 340, in a substantially radial direction relative to the injection axis 312, and into the flow paths 352, where the gaseous fuel 20 mixes with the compressed air 18. The gaseous fuel 20 and the compressed air 18 form a fuel/air mixture, which is injected with the liquid fuel mixture through the outlet member 310 into the secondary combustion zone 160 (as shown in FIG. 2).

The methods and systems described herein facilitate the introduction of liquid fuel in a downstream fuel stage in a combustor. More specifically, the methods and systems facilitate delivering liquid fuel and water through a fuel injector in such a way as to improve the distribution of the liquid fuel throughout the compressed gas. The methods and systems therefore facilitate improving the overall operating efficiency of a combustor such as, for example, a combustor in a turbine assembly. This increases the output and reduces the cost associated with operating a combustor such as, for example, a combustor in a turbine assembly. Moreover, the present fuel injectors provide greater operational flexibility in that the fuel injectors are configured to burn both liquid fuel and natural gas sequentially or simultaneously.

Exemplary embodiments of fuel injectors and methods of fabricating the same are described above in detail. The methods and systems described herein are not limited to the specific embodiments described herein, but rather, components of the methods and systems may be utilized independently and separately from other components described herein. For example, the methods and systems described herein may have other applications not limited to practice with turbine assemblies, as described herein. Rather, the methods and systems described herein can be implemented and utilized in connection with various other industries.

While the invention has been described in terms of various specific embodiments, those skilled in the art will recognize that the invention can be practiced with modification within the spirit and scope of the claims.

What is claimed is:

1. A fuel injector for a gas turbine combustor, the fuel injector comprising:

a body comprising a frame defining an inlet portion and an outlet member extending downstream from the frame and defining an outlet portion, the body defining an air flow path from the inlet portion through the outlet portion, and the outlet member defining therein a mixing chamber, wherein the frame defines a leading end wall and a trailing end wall opposite the leading end wall, relative to a flow of combustion products through the gas turbine combustor, the frame further defining a pair of side walls between the leading end wall and the trailing end wall;

a first fuel injection vane extending across the frame from the leading end wall to the trailing end wall, such that the air flow path extends between the vane and the pair of side walls of the frame;

a fuel chamber defined within the first fuel injection vane, the fuel chamber being in flow communication with the air flow path via a vane fuel injection aperture defined in the first fuel injection vane;

a gaseous fuel supply conduit in flow communication between a source of gaseous fuel and the vane fuel injection aperture, via the fuel chamber;

a fuel plenum defined within the outlet member;

a fuel injection port defined through the outlet member and in flow communication with the fuel plenum; and a liquid fuel supply conduit fixed to the body, wherein the liquid fuel supply conduit is in flow communication between a source of liquid fuel and the fuel injection port, via the fuel plenum.

2. The fuel injector of claim 1, wherein the liquid fuel supply conduit comprises co-axial tubes including a first tube and a second tube surrounding the first tube; and wherein the first tube is in flow communication with the source of liquid fuel and the second tube is in flow communication with a source of water.

3. The fuel injector of claim 2, wherein the first tube and the second tube are in flow communication with the fuel plenum, such that a mixture of liquid fuel and water is conveyed through the fuel injection port into the mixing chamber.

4. The fuel injector of claim 2, further comprising a second plenum defined in the outlet member proximate the fuel plenum and a fluid injection port defined through the outlet member in axially spaced relation to the fuel injection port, the fluid injection port being in flow communication with the second plenum; and the second tube being in flow communication with the second plenum.

5. The fuel injector of claim 4, wherein the fluid injection port is located upstream of the fuel injection port, relative to the air flow path through the body.

6. The fuel injector of claim 1, wherein the outlet member defines a leading edge relative to the flow of combustion products through the combustor; and wherein the fuel plenum is positioned within the leading edge, and the fuel injection port is located proximate the leading edge.

7. The fuel injector of claim 1, wherein the fuel injection port comprises a plurality of fuel injection ports, each port of the plurality of fuel injection ports being in flow communication with the fuel plenum.

8. The fuel injector of claim 7, wherein the plurality of fuel injection ports is arranged in an axially spaced configuration, relative to the air flow path through the body.

9. The fuel injector of claim 8, wherein the plurality of fuel injection ports comprises a first port having a first diameter, a second port having a second diameter smaller than the first diameter, and a third port having a third diameter smaller than the second diameter; and wherein the first port is axially upstream of the second port and the second port is axially upstream of the third port.

10. The fuel injector of claim 7, wherein the fuel plenum extends circumferentially through at least a portion of a perimeter of the outlet member, and wherein the plurality of fuel injection ports is arranged circumferentially about the corresponding at least a portion of the perimeter of the outlet member, each of the plurality of fuel injection ports being in flow communication with the fuel plenum.

11. The fuel injector of claim 10, wherein the outlet member defines a leading edge relative to the flow of combustion products through the combustor; and wherein the plurality of fuel injection ports is distributed around the leading edge.

12. The fuel injector of claim 11, wherein the fuel plenum extends circumferentially through an entire perimeter of the outlet member, and wherein the plurality of fuel injection ports is arranged circumferentially about the entire perimeter of the outlet member.

13. The fuel injector of claim 10, wherein the outlet member defines a leading edge and a trailing edge opposite the leading edge, relative to the flow of combustion products through the combustor, the pair of side walls being defined between the leading edge and the trailing edge; and wherein the plurality of fuel injection ports is distributed in greater concentration around the leading edge than along the pair of side walls and the trailing edge.

14. The fuel injector of claim 1, wherein the fuel injection port is angled relative to an inner surface of the outlet member.

15. The fuel injector of claim 14, wherein the fuel injection port comprises a plurality of fuel injection ports, each port of the plurality of fuel injection ports being in flow communication with the fuel plenum; and wherein the plurality of fuel injection ports comprises fuel injection ports of different angular orientation relative to the inner surface of the outlet member.

16. The fuel injector of claim 1, further comprising a second fuel injection vane extending across the frame from the leading end wall to the tailing end wall in parallel to the first fuel injection vane, the second fuel injection vane defining a second fuel chamber therein in flow communication with the gaseous fuel supply conduit and further defining a second vane fuel injection aperture in flow communication with the second fuel chamber and the air flow path.

17. The fuel injector of claim 1, further comprising a second fuel injection vane extending across the frame from the leading end wall to the tailing end wall in parallel to the first fuel injection vane, the second fuel injection vane defining a second fuel chamber therein in flow communication with a second fuel supply conduit and a second fuel injection aperture in flow communication with a second fuel chamber and the air flow path.

* * * * *